United States Patent [19]

Cotter

[11] 4,079,693

[45] Mar. 21, 1978

[54] APPLICATION FOR COATING INTERNAL SURFACES

[75] Inventor: Robert John Cotter, Meriden, Conn.

[73] Assignee: Loctite Corporation, Newington, Conn.

[21] Appl. No.: 646,811

[22] Filed: Jan. 5, 1976

[51] Int. Cl.[2] ..... B05C 3/18; B05C 7/00

[52] U.S. Cl. ..... 118/3; 118/6; 118/408

[58] Field of Search ..... 118/1, 2, 3, 7, 8, 408, 118/404, 405, 411, 410; 427/230–232, 235, 238, 239

[56] References Cited

U.S. PATENT DOCUMENTS

| | | | |
|---|---|---|---|
| 2,324,455 | 7/1943 | Keim et al. | 118/408 X |
| 2,412,954 | 12/1946 | Zdancewicz | 118/408 |
| 2,426,969 | 9/1947 | Hallowell, Jr. | 118/408 |
| 3,104,986 | 9/1963 | Goman et al. | 118/2 |
| 3,266,459 | 8/1966 | Anthony | 118/1 |
| 3,682,131 | 8/1972 | Algeri et al. | 118/2 |
| 3,817,210 | 6/1974 | Greever | 118/408 |
| 3,889,628 | 6/1975 | Usab | 118/408 X |

*Primary Examiner*—Morris Kaplan

*Attorney, Agent, or Firm*—Watson, Cole, Grindle & Watson

[57] ABSTRACT

An applicator for applying a layer of coating material around the circumference of an internal surface of a bore within a member, such as on the internal surface of an elongated socket. The applicator includes a chamber which has an elongated portion which can be inserted within the bore of the member to be coated. This chamber is then filled with the coating material to be applied. When the member to be coated is arranged on the elongated portion of the chamber, such arrangement is sensed and serves to actuate a mechanism for providing an opening within the elongated portion. Coating material then passes through this opening into contact with the internal surface of the member.

7 Claims, 18 Drawing Figures

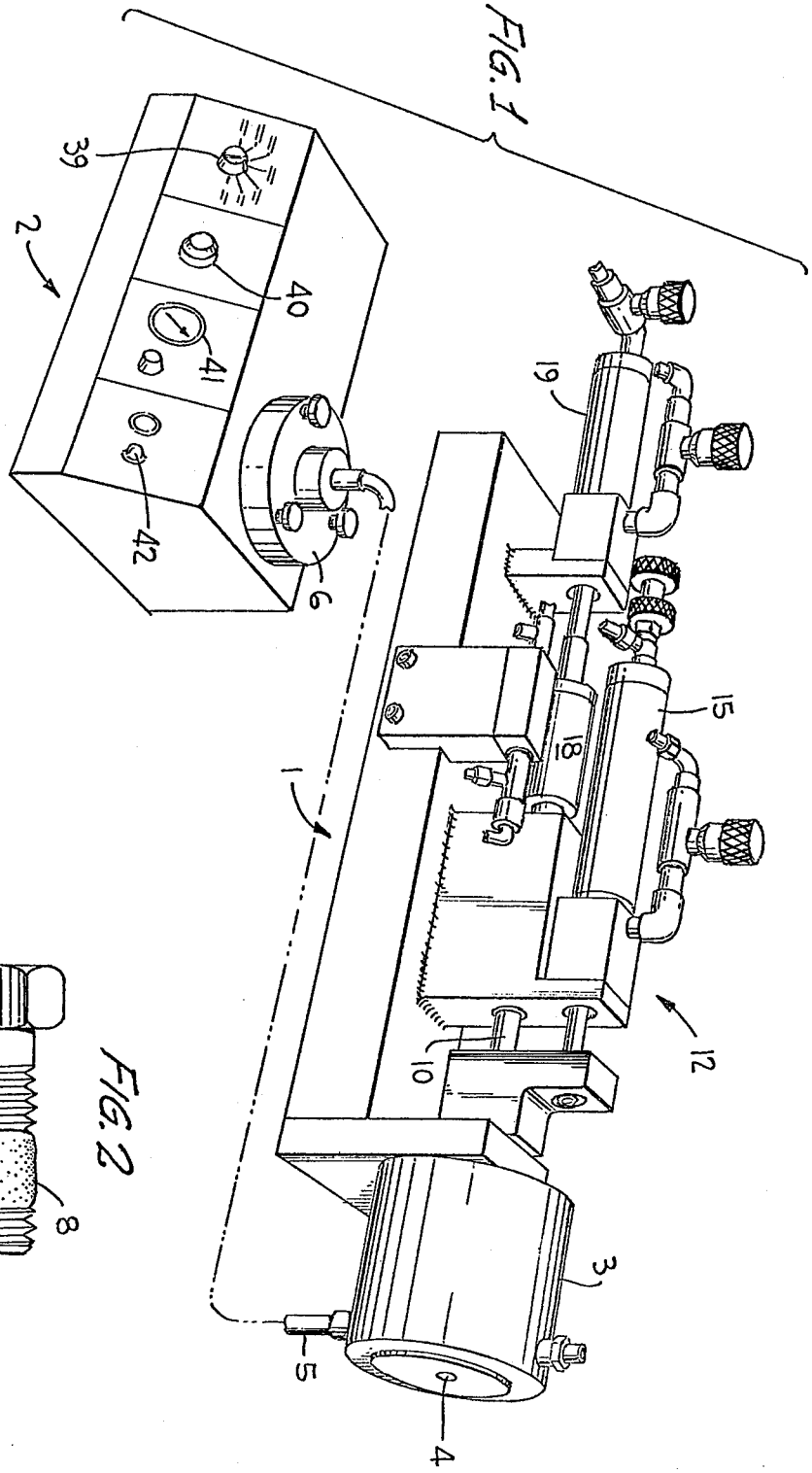
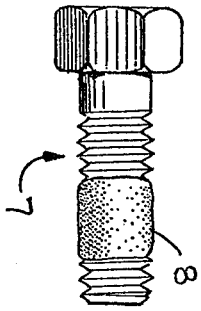
FIG. 2

APPLICATION FOR COATING INTERNAL SURFACES

BACKGROUND OF THE INVENTION

The present invention relates to a coating applicator for applying a layer of coating material to an internal surface of a member, such as on the surface of a bore within an elongated element.

Various different coating apparatuses for coating elongated members, such as pipes and bolts, have been developed in the prior art. One type of system includes a chamber which is passed along an elongated member while coating material is applied through grooves within the chamber for coating the elongated member. Such systems are illustrated in U.S. Pat. Nos. 2,305,005 issued to R. E. Henry; 2,429,915 issued to W. H. Bell; and, 2,892,441 issued to D. E. Stearns.

Another type of system was developed by the assignee of the present application as shown in U.S. Pat. No. 3,795,224 issued to R. E. Batson et al, for coating a plurality of headed bolts. In this system, the bolts are conveyed along an assembly line and pass by a coating block which dispenses coating material into contact with the bolts. This system is designed for mass production coating of elongated members and thus, the members to be coated are rapidly conveyed along the conveying path past the coating station. As the members are so conveyed, they are rotated by the conveyor so that the applied coating material is smoothed on and spread evenly around the circumference of the bolt.

None of the above systems, however, are involved with providing a semi-automatic coating applicator for coating a limited number of elongated members. One previously developed system involved with such an objective, was developed by the assignee of the present application. In this system, a bolt was inserted through an opening in the chamber. After the bolt was inserted, a valve mechanism allowed coating material to flow through a plurality of apertures on the interior surface of the chamber so as to come into contact with the circumference of the bolt. The coated bolt was then removed by hand and another bolt inserted. Thus, the flow of coating material was controlled by a valve member located in the feedline for the coating material so that coating material only flowed when the valve was opened after insertion of the bolt.

In order to provide a semi-automatic coating applicator, another system was developed as disclosed in U.S. Patent Application Ser. No. 646,801, to Robert Cotter (the applicant of the present application) and Martin Cosgrove, which has been filed on the same day as the present application. The system disclosed in that application is directed to coating the external surface of an elongated member.

In the coating applicator disclosed in the Patent Application to Robert Cotter and Martin Cosgrove, a coating chamber having an opening for receiving the elongated member which is to be coated, is filled with coating material. The opening has dimensions just slightly larger than the cross-section of the elongated member, so that there can be a close fit of the member within the opening. A retractable cover member is arranged within the chamber for preventing coating material from leaking out of the chamber through the opening. Upon insertion of the elongated member through the opening into the chamber, the cover member is retracted so as to allow coating material to totally surround the entire circumference of a limited longitudinal portion of the elongated member. A coating layer is then applied to the elongated member. After the elongated member has been coated, the member is removed from the chamber. Due to the dimensioning of the inner walls of the chamber, as the coated member is removed, the walls serve to remove excess coating material and to smooth the coating material on the member. After the elongated member has been coated, the member is automatically ejected from the chamber. Immediately prior to the ejection of the elongated member, the cover member is returned to its initial position so as to prevent leakage of coating material through the opening.

While any type of coating material could be applied by the coating applicator illustrated in the above-noted Patent Application, the coating material primarily of concern is a slurry containing an adhesive material. The coating material contains a solvent, which is generally water or another solvent which can be easily driven off if the coated layer on the elongated member is to be dried.

Since many members, such as bolts, which are to be coated originally come from the factory with a thin layer of oil or grease on their exterior surfaces, it is necessary to first remove this layer before applying the coating material. This factor is well known in the prior art and in fact is discussed in the U.S. patent to Batson et al. For this reason, the elongated members are first degreased by any type of conventional degreasing equipment so as to provide a clean surface for good adhesion for the coating material. The degreased members are then supplied with a coating layer by the coating applicator of the present invention. Subsequently, a thin layer of oil can again be supplied to the exterior surface of the elongated member and the coated area. The re-application of the oil, however, is an optional process depending upon the particular use to be made of the member and the period of time before such use. The coated and oiled members can then be dried in an oven so as to substantially drive out any solvent present in the applied layer of coating material.

Those coating systems described above are concerned with coating an external surface of a member. Other coating systems, however, have been developed for coating internal surfaces of a member. These systems generally include an applicator nozzle having an opening in its tip, which is inserted into the bore of the member to be coated. Once the applicator is inserted, a pressure valve is opened thereby allowing material to flow through the applicator and out of the opening. The coating material then comes into contact and coats the internal surface of the bore. These systems are typically hand-operated systems in that either the applicator must be hand held and placed into contact with the internal surface of the bore or the bore member must be hand held in contact with the applicator. Consequently, the rate at which members can be coated is significantly limited with these types of systems.

SUMMARY OF THE INVENTION

An object of the present invention is to provide a semiautomatic coating applicator for applying a layer of coating material around the circumference of an internal surface of a bore within a member.

Another object of the present invention is to provide a coating applicator which is capable of automatically coating a limited portion of the internal surface of the member in such a manner so as to enable a large number of such members to be coated within a short period of time.

A further object of the present invention is to provide a coating applicator in which the members to be coated can be arranged in contact with a chamber filled with coating material, which chamber automatically provides an opening within a portion of its walls for allowing coating material to flow out into contact with the internal surface after having sensed the presence of such a member to be coated.

These objectives are achieved by the utilization of the coating applicator of the present invention. This applicator includes a chamber having an elongated portion with an external wall. This portion of the chamber can be inserted within the bore of the member which is to be coated. The chamber is always maintained in a filled condition with coating material. A mechanism is provided for sensing when a member which is to be coated is arranged on the elongated portion. Upon a determination of the presence of such a member, an opening is provided within the external wall of the elongated portion of the chamber thereby allowing coating material to pass through the opening into contact with the internal surface of the member.

While the coating applicator of the present invention has been devised for coating internal surfaces, the details of this applicator along with the control mechanism has many features in common with the coating applicator described in U.S. Patent Application Ser. No. 646,801 to Robert Cotter and Martin Cosgrove, which was referred to above. In both of these systems, the chamber is always filled with a coating material and through the movement of an appropriate member, this coating material is allowed to come into contact with the surface of the member which is to be coated.

At least a section of the lateral end wall of the chamber and at least a section of the elongated portion of the chamber are arranged so as to be movable in a direction for providing an opening in the external wall of the elongated portion. Thus, when a member is arranged on the elongated portion, the member presses against the lateral end wall of the chamber thereby pushing the movable sections back and providing for an opening in the elongated portion. The coating material is then allowed to flow through this opening into contact with the exposed portions of the internal surface of the member. After a set time period, the movable sections of the chamber are automatically returned to their initial positions and the coated member is ejected from its location in contact with the chamber. The details of the control for these operations of the coating applicator of the present invention are similar to those described in the above-noted U.S. Patent Application to Robert Cotter and Martin Cosgrove.

BRIEF DESCRIPTION OF THE DRAWINGS

FIGS. 1 through 12 illustrate the coating applicator described in the previously noted Patent Application to Robert Cotter and Martin Cosgrove.

FIG. 1 is a perspective view of that coating applicator including the control mechanism, for coating elongated members.

FIG. 2 is a side elevational view of an elongated member which has had a limited longitudinal portion coated by the coating applicator illustrated in FIG. 1.

FIG. 3 is a side elevational view of the coating applicator illustrated in FIG. 1 with portions being partially cut away so as to illustrate interior members of the coating applicator.

FIG. 4 is a plan view of the coating applicator illustrated in FIG. 1 with portions removed for the sake of clarity.

FIG. 5 is a perspective view of a portion of the coating applicator illustrated in FIG. 1, with the cover plate of the coating chamber being removed.

FIG. 6 is a perspective view of the coating applicator illustrated in FIG. 1 mounted on a platform for operation with its coverning housing in place.

FIGS. *7a* through *7e* are side elevational sectional views of a portion of the coating applicator illustrated in FIG. 1 during various stages of its operation.

Figure 8:
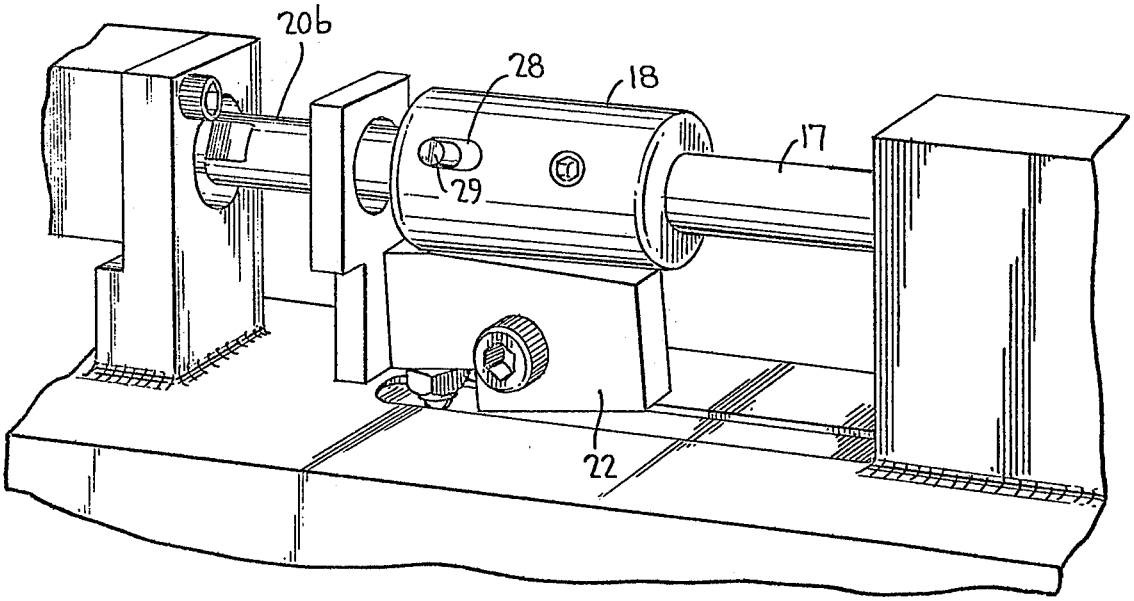

FIG. 8 is a side perspective view of a portion of the coating applicator illustrated in FIG. 1 during one stage of its operation.

Figure 9:
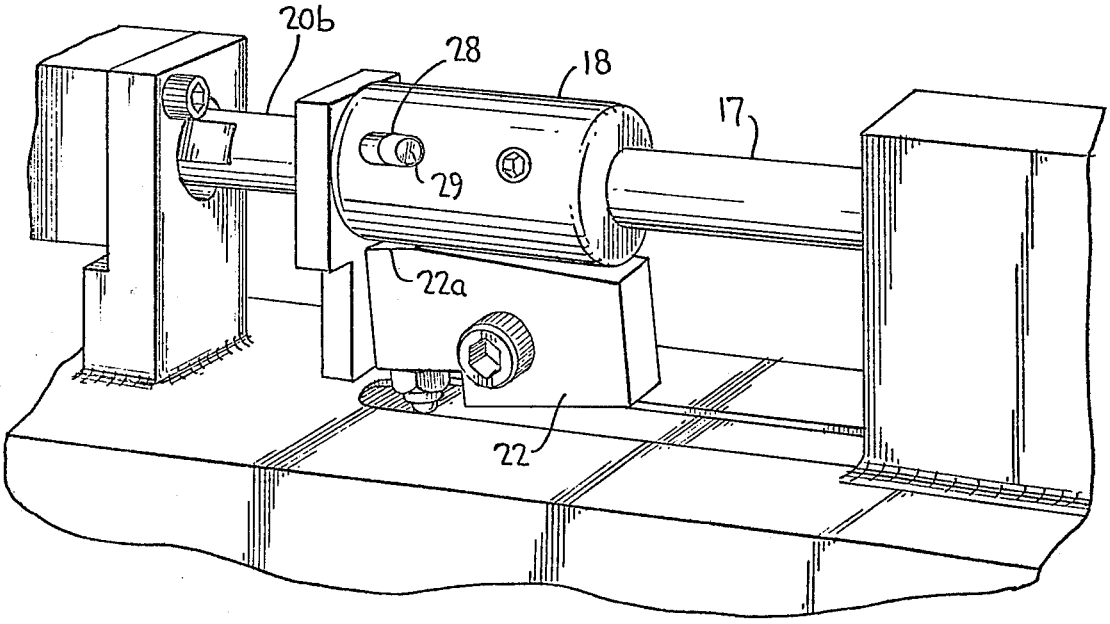

FIG. 9 is the same portion of the coating applicator illustrated in FIG. 8 during another stage of its operation.

Figure 10:
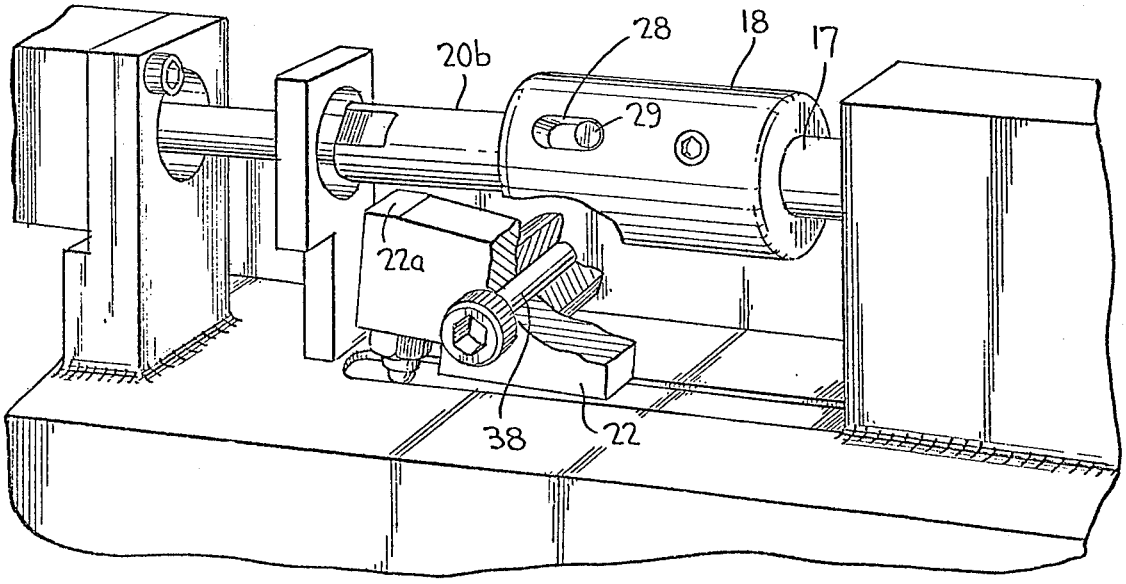

FIG. 10 is another view of the portion of the coating applicator illustrated in FIG. 8 during still another stage of its operation.

Figure 11:
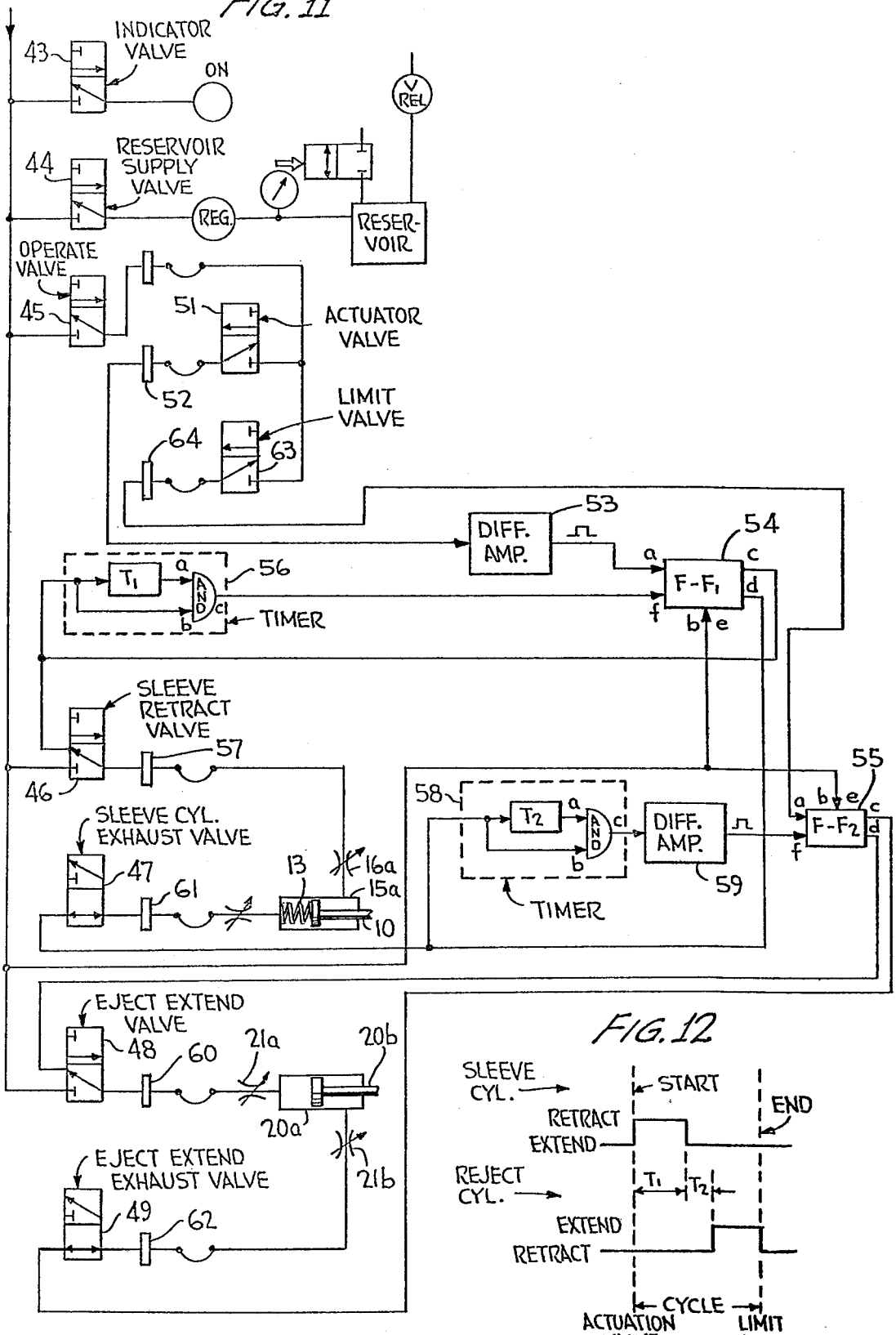

FIG. 11 is a pneumatic circuit diagram illustrating the system for controlling the coating applicator illustrated in FIG. 1.

Figure 12:
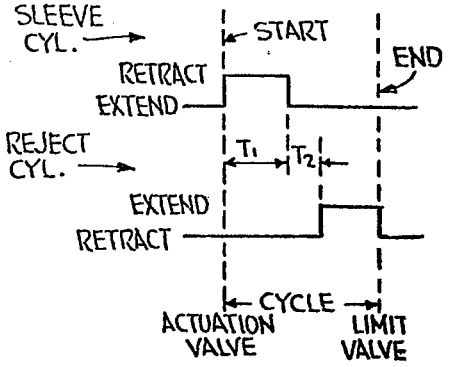

FIG. 12 is a pulse diagram of the control signals generated by the control system illustrated in FIG. 11.

Figure 13:
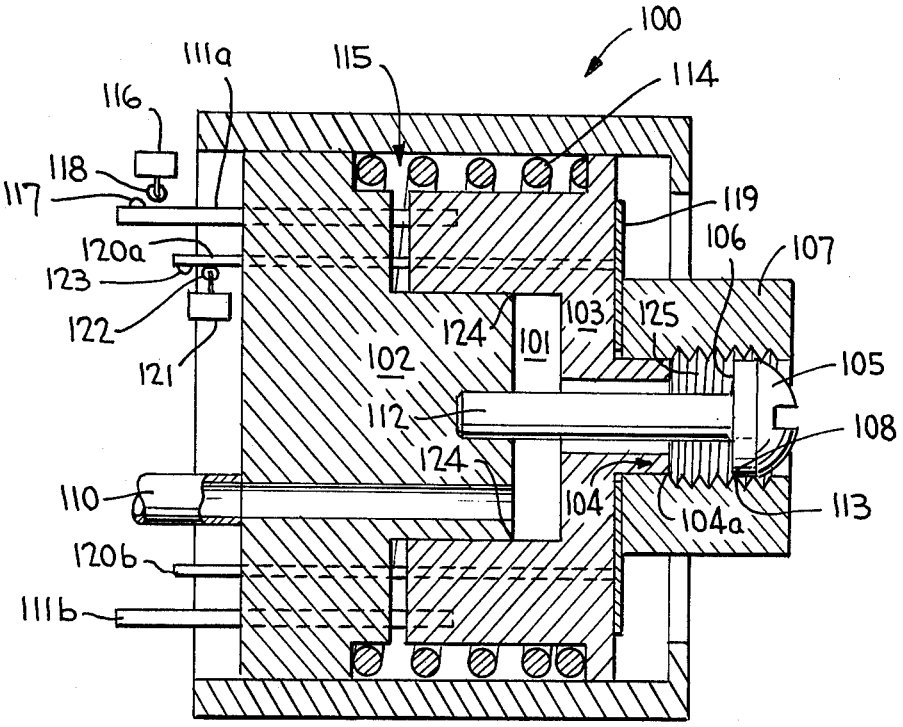

FIG. 13 is a side sectional view of an applicator for coating internal surfaces in accordance with the present invention.

Figure 14:
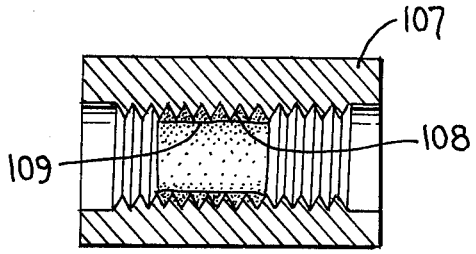

FIG. 14 is a cross-sectional view of a member with the threads on its internal surface having been coated by the applicator of the present invention.

DESCRIPTION OF THE PREFERRED EMBODIMENT

A description of the coating applicator illustrated in FIGS. 1 through 12 is first provided below. This coating applicator includes a coating device 1 and a corresponding control device 2, as shown in FIG. 1. Coating device 1 has a chamber 3 which can have its interior hollow section 9 (see FIG. 3) filled with a coating material through feedline 5 from reservoir 6. The longitudinal end wall of the chamber is formed by a plate 32 which is provided with an opening 4, defined by inner wall 33. Opening 4 extends in a direction parallel to the longitudinal axis of chamber 3. It is through this opening 4 that an elongated member, such as bolt 7 (see FIG. 2), is inserted for being coated.

While the coating material is generally utilized as a slurry, it is not necessary that the material be in such form. The only requirement regarding the coating material is that it have a sufficient viscosity so as to not be capable of leaking through opening 4 when it is sealed by a cover member.

In FIG. 2, a bolt 7 which has been supplied with a layer of coating material 8 is illustrated. Coating layer 8 has been applied along a limited longitudinal portion of the threaded section of the bolt 7. While the coating layer does not extend along the whole length of bolt 7, it does totally surround the circumference of the limited longitudinal portion.

Figure 3:
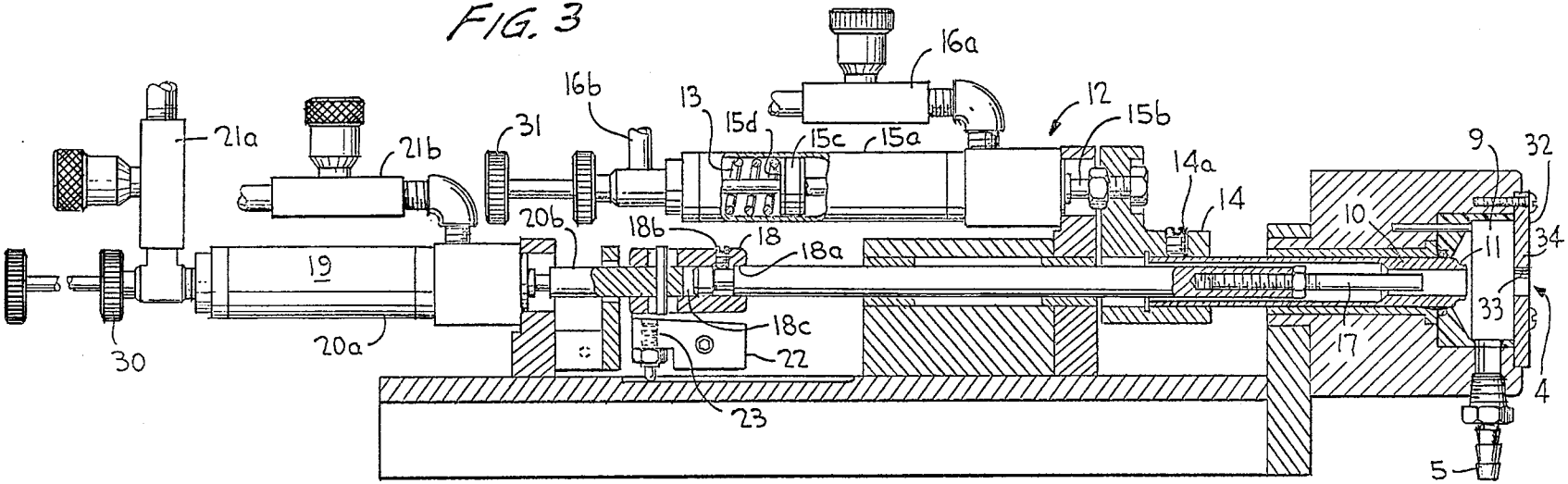
Figure 4:
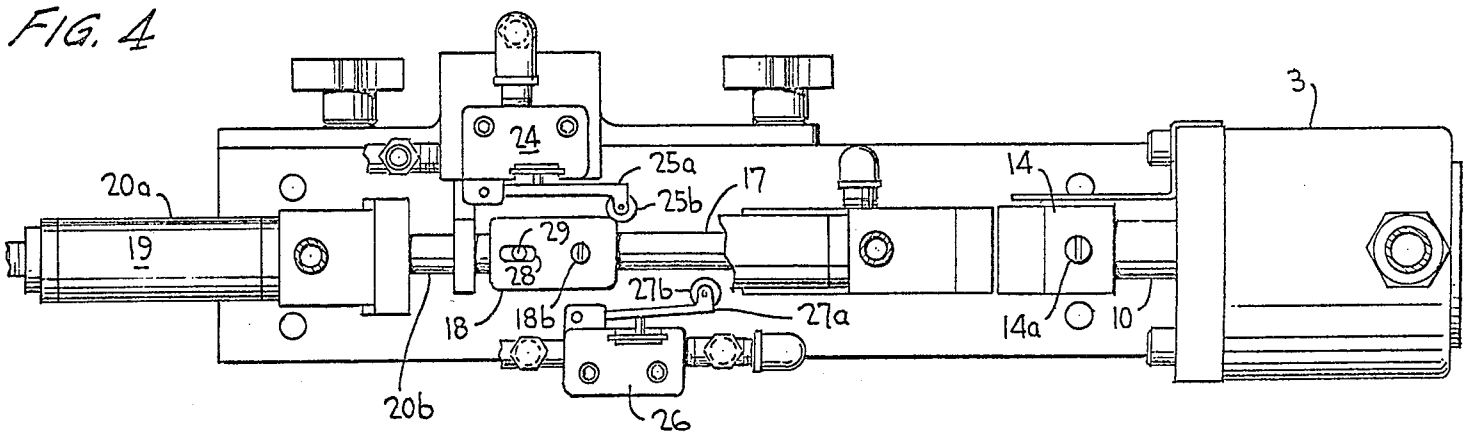

A cover member for preventing coating material from leaking through opening 4 is formed by sleeve member 10 (see FIGS. 3 and 4). Sleeve member 10, when in its closed position, has its end lateral surface in contact with inner wall 34 of plate 32. In this closed position, the sleeve surrounds the outer perimeter of opening 4 and prevents coating material from leaking through the opening. End surface 11 of sleeve 10 which is to be located adjacent to wall 34 is contoured so as to have a smaller outer dimension than the remaining portion of sleeve 10. This contouring of surface 11 is done in order to provide for beneficial flow forces of the coating material away from the area of opening 4. Thus, as sleeve 10 moves toward opening 4, the coating material easily flows along this contoured section away from opening 4. Due to the relatively small area of contact, an extremely good seal can be maintained between the lateral end surface of sleeve 10 and wall 34.

Mounted within sleeve 10 is a rod 17. Rod 17 has its longitudinal axis extending in a direction parallel to sleeve 10, chamber 3 and opening 4. While one end of rod 17 is mounted so as to move towards opening 4, its other end is coupled to a bushing 18. Bushing 18 has a cylindrical bore; rod 17 enters one end of this bore and is secured therein by a corresponding set screw **18*b***.

Sleeve 10 is mounted within a bore in a block 14 and secured in place by a set screw **14*a*. Block 14 is connected to a pneumatic mechanism 12 for controlling the retraction of sleeve 10 away from opening 4 in plate 32. Sleeve 10 can be biased by a spring 13 so as to be normally held in a closed position in contact with inner wall 34. Upon receipt of an actuating signal, however, retracting mechanism 12 causes sleeve 10 to move in a direction away from wall 34. Retracting mechanism 12 includes a pneumatic cylinder 15*a* and a piston shaft shaft 15*b*. Upon receipt of an appropriate signal, air is supplied through a port 16*a* thereby causing pressure on one face of plate 15*c* and causing piston shaft 15*b* to retract into cylinder 15*a*. Upon retraction of shaft 15*b*, block 14 and correspondingly sleeve 10 are moved in a direction away from opening 4 and wall 34. After a set time period, the air within cylinder 15*a* is allowed to exhaust through port 16*a* and air is supplied through port 16*b* thereby causing pressure on face 15*d* of plate 15*c*. This pressure on face 15*d* along with the force of spring 13 return sleeve 10 to its normally closed position. Spring 13 furthermore acts as a safety mechanism in case the air supply through port 16*b* is accidentally shut off. The spring ensures that the sleeve still will be returned to its closed position. Without this spring, the residual air pressure in the reservoir would push the sleeve away from inner wall 34 thereby allowing the coating material to spill out through opening 4**.

The extent to which sleeve 10 is retractable can be adjusted by control knob 31. Rotation of knob 31 will control the extent to which plate **15*c* can be retracted within cylinder 15*a***.

While rod 17 is mounted within one end of bore **18*a*, a pneumatic ejection mechanism 19 is coupled to the other end of bushing 18 by a piston shaft 20*b* entering the opposite end of bore 18*a*. Ejection mechanism 19 includes a pneumatic cylinder 20*a* and piston shaft 20*b*. Shaft 20*b* has an externally extending pin 29 which is mounted so as to be slidable within a slot 28 within bushing 18, as shown in FIG. 4. Rod 17 and the end of piston shaft 20*b* are separated by a free space 18*c* within bushing 18**.

Two switch mechanisms 24 and 26 are mounted along the longitudinal axis of the coating applicator so as to be capable of being actuated by movement of bushing 18. Switch mechanism 24 has a lever **25*a* with a corresponding roller 25*b* mounted along one side of bushing 18. Switch mechanism 26 has a lever 27*a* with a corresponding roller 27*b* and is mounted along the opposite side of bushing 18 from switch mechanism 24**. While the longitudinal positions of the switch mechanisms are significant, for reasons which will be clear from the description of the operation of the coating applicator as presented further below, the circumferential positions of the switch mechanisms can be varied.

Figure 5:
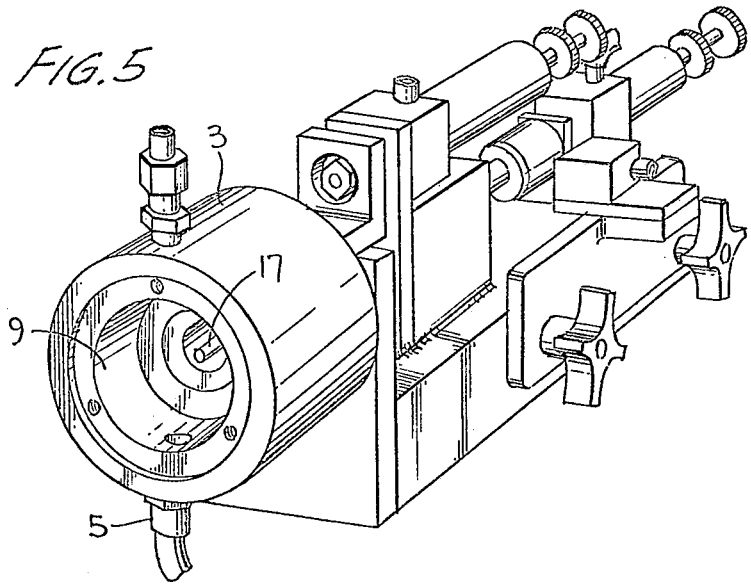
Figure 6:
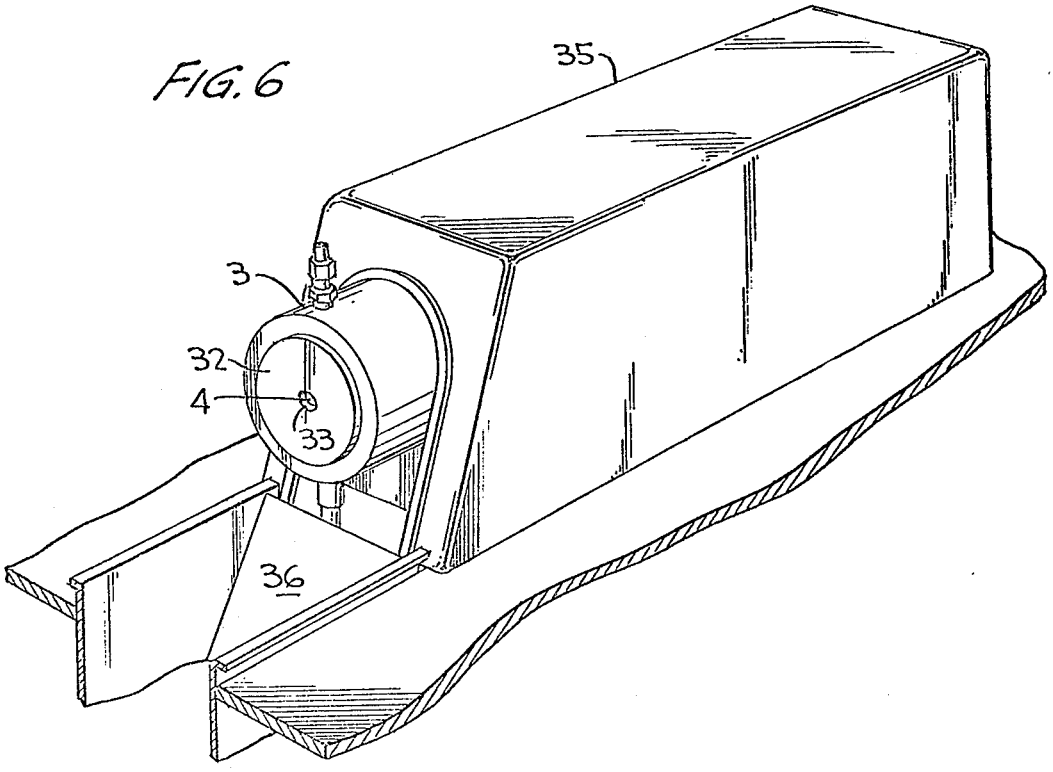

Interior 9 of chamber 3 is illustrated in FIG. 5, where plate 32 has been removed. As can be seen, rod 17 extends along the longitudinal axis of the chamber into interior space 9 of the chamber. In FIG. 6, the applicator is illustrated with plate 32 having been placed into position and housing cover 35 having been arranged over the working parts of the coating device 1. The elongated members after they are ejected from the applicator drop onto a chute 36 down to a collection pan (not shown) which is located below. If the elongated members are to be re-oiled, a stream of oil can be supplied along chute 36 so that as the members fall the oil is again supplied to the members.

Figure 7A:
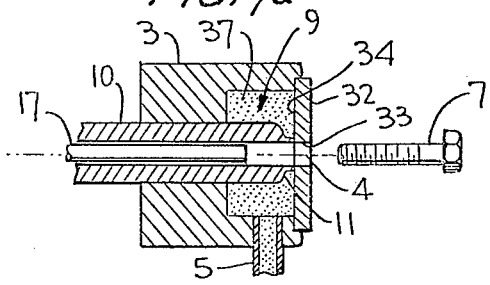

The operation of the coating applicator will now be described with reference to FIGS. **7*a* through 7*e*. During the rest position of the applicator and also during the period when the applicator is being filled with coating material, sleeve 10 is forced against inner wall 34 of cover plate 32. Coating material, such as an adhesive slurry, which is maintained under pressure is transmitted from a reservoir 6 through feedline 5 to the bottom side of chamber 3. Thus, interior space 9 of chamber 3 is filled with a coating material 37, as shown in FIG. 7*a*. When sleeve 10 is in this position, it serves as a cover member for covering the opening 4** and prevents coating material from leaking through the opening.

An elongated member, such as bolt 7, which is to be coated, is inserted through opening 4 in cover plate 32 and into sleeve 10. Bolt 7 when inserted pushes firmly against rod 17 thereby causing it to slightly move further away from opening 4 (see FIG. **7*b*). As rod 17 is moved back, it in turn causes bushing 18 to also move along its longitudinal axis in a direction away from opening 4. As bushing 18 is thus moved, roller 25*b* (see FIG. 4) slips off of bushing 18 thereby actuating switch mechanism 24**.

Upon actuation of switch mechanism 24, a timing circuit is energized. The timing circuit forces sleeve 10 to pull away from inner wall 34 of plate 32. As sleeve 10 is retracted, the threads of bolt 7 are exposed to the coating material within chamber 3. The sleeve is only retracted by a predetermined distance which is adjusted by control knob 31 (as described above). The pressurized coating material is forced around the exposed threads of bolt 7 while bolt 7 is supported by plate 32 and sleeve 10 (see FIG. **7*c***).

Figure 7B:
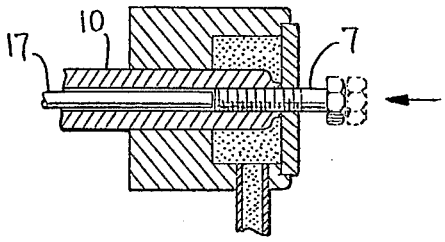
Figure 7C:
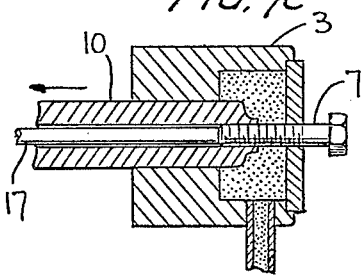
Figure 7D:
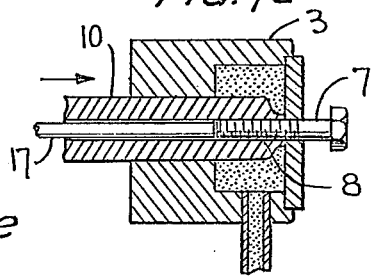
Figure 7E:
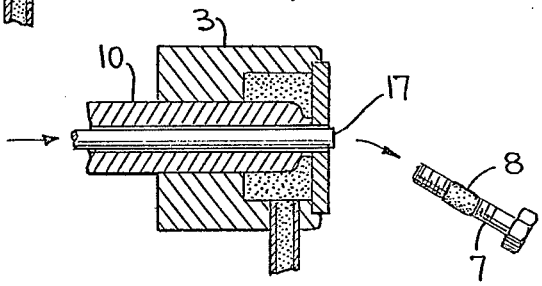

After a set time period, as determined by a timing circuit, sleeve 10 is allowed to return to its initial position. For this purpose, the air within pneumatic cylinder **15*a* is exhausted through port 16*a*. Air pressure is then applied through port 16*b* against face 15*d* of plate 15*c*. This pressure on face 15*d* along with spring 13 cause sleeve 10 to return to its initial position. The inner dimensions of sleeve 10 are appropriately dimensioned so that they are only very slightly larger than the outer dimensions of bolt 7. Consequently as sleeve 10 advances forward towards inner wall 34 of plate 32** the coating material is forced down into the threads of the bolt, the surface of the coated threads are smoothed and the excess slurry is displaced back into the chamber. During this operation, the contoured nature of surface 11 of sleeve 10 helps to allow the excess slurry to move away from the bolt back into the chamber. Bolt 7 with a layer of coating 8 is illustrated in FIG. 7*d* after sleeve 10 has been returned to its initial position.

Subsequent to the coating of bolt 7, rod 17 is advanced towards opening 4 thereby causing the ejection of bolt 7 from chamber 3. Ejection is accomplished through the extension of piston shaft 20*b* from cylinder 20*a* by pneumatic ejection mechanism 19. As the coated bolt is ejected, wall 33 of opening 4 helps to wipe off any excess coating material and to smooth out the layer of coating material on the bolt. After the bolt is ejected, rod 17 returns to its retracted position ready to begin another cycle.

A further explanation of the operation of the ejection mechanism will now be provided with reference to FIGS. 8 through 10. In its initial position, the lateral end surface of rod 17 positioned within bore 18*a* is separated by a free space 18*c* from the lateral end surface of piston shaft 20*b*. In this position, pin 29 is located at the end of slot 28 closest to cylinder 20*a*. When bolt 7 is inserted into the chamber, thereby pushing back rod 17 as shown in FIG. 7*b*, bushing 18 rides along pin 29 towards cylinder 20*a* into the position illustrated in FIG. 9. After coating of bolt 7 has been completed, as shown in FIG. 7*d*, shaft 20*b* is extended from cylinder 20*a*. Extension of shaft 20*b* is caused by the supply of air through inlet 21*a*. This causes pin 29 to push against the end of slot 28 closest to rod 17 thereby pushing bushing 18 and rod 17 towards opening 4, as illustrated in FIG. 10. As rod 17 moves toward opening 4, bolt 7 is ejected from coating chamber 3.

When bushing 18 reaches a predetermined forward position, it contacts roller 27*b* of limiting switch 26. This in turn causes ejection mechanism 19 to stop the forward motion of piston shaft 20*b* thereby ending the forward movement of rod 17. Limiting switch 26 also causes ejection mechanism 19 to cause piston shaft 20*b* to return to its initial position. For this purpose, the air within cylinder 20*a* is exhausted through outlet valve 21*b* thereby causing piston shaft 20*b* to retract back into cylinder 20*a*.

During such retraction, pin 29 is in the position within slot 28 as shown in FIG. 8. During this retraction, bushing 18 comes into friction contact with block 22. Block 22 is mounted so as to be pivotable about rod 38. End 22*a* of block 22 is spring biased by a spring 23 in an upward direction. Thus, as bushing 18 comes into contact with block 22, the block is pushed against the bushing thereby slowing down its movement and preventing any bounce in the movement of bushing 18 and rod 17 as they are retracted back to their initial position as shown in FIG. 18.

The coating applicator is controlled by an air logic control mechanism contained within control system 2, as shown in FIG. 1. The operation of this control system will be explained below with reference to the circuit diagram illustrated in FIG. 11 and pulse diagram illustrated in FIG. 12.

When selector switch 39 on the control panel is set into its operate mode, the reservoir supply valve 44 is closed so as to fill interior 9 of chamber 3 with coating material. The indicating valve 43 indicating that the machine is on and operating is also closed. The sleeve exhaust and sleeve retract valves (47 and 46) are maintained in their normal positions. Likewise, the eject extend valve and the exhaust valve (48 and 49) are also maintained in their normal positions. Valves 46, 47 and 48, 49 can be utilized for manually retracting the sleeve cylinder and extending the eject cylinder, respectively, when setting up and cleaning out the system. At all other times, these valves remain in their normal positions as shown in FIG. 11.

Finally, operate valve 45 is switched into a closed position so as to allow for initiation of operation. Upon selection of the operate mode, sleeve 10 is maintained in the extended position through signals from flip-flop ($F—F_1$) 54, at ports *b–e* and *d* and the eject cylinder is maintained in a retract position through signals from flip-flop ($F—F_2$) 55 at ports *b–e* and *c*.

Upon insertion of bolt 7, actuator 51 supplies an air pulse through bulkhead 52 to differential amplifier 53. In turn, differential amplifier 53 provides a pulse signal to set port terminal *a* of flip-flop 54 and thereby actuating flip-flop 54.

Upon actuation of flip-flop 54, the output at port *d* is switched off and the output at port *c* is switched on thereby providing a signal to both sleeve retract valve 46 and timer 56. Actuation of sleeve retract valve 46 causes bulkhead 57 to supply air to sleeve cylinder 15*a* through inlet 16*a*. This causes sleeve 10 to retract from its position against inner wall 34.

The air signal supplied to timer 56 is supplied to both input terminal *b* of the AND-gate and through a slow, pressurized timing circuit $T_1$. After the delay caused by timing circuit $T_1$, a signal is supplied to second input terminal *a* of the AND-gate. In turn, an output is then supplied from the AND-gate at terminal *c*. This output, in turn, is sent back to flip-flop 54 through reset port *f*. The output at port *c* of flip-flop 54 is then switched off and the output at port *d* is switched back on thereby providing a signal through sleeve exhaust valve 47 and hence bulkhead 61 so as to cause sleeve 10 to return to its extended position. The output at port *d* of flip-flop 54 also provides an input signal at port *a* of timer 58.

Timer 58 operates in the same manner as timer 56 and after a set time delay period, an output is provided to differential amplifier 59. The differential amplifier converts the signal from the timer into a pulse to be supplied to set port *f* of flip-flop 55. In turn, the output at port *c* of flip-flop 55 is switched off and the output at port *d* switches back on thereby providing a signal through eject extend valve 48 and hence bulkhead 60 so as to supply air through input line 21*a* so as to cause piston shaft 20*b* to extend from cylinder 20*a*. Extension of piston shaft 20*b* in turn causes rod 17 to knock the coated bolt out of the coating chamber.

When piston shaft 20*b* has been extended to its full stroke, limit valve 63 is actuated so as to supply an air pulse through bulkhead 64. This signal in turn is transmitted to reset port *a* of flip-flop 55. The output at port *d* of flip-flop 55 is then switched off and the output at port *c* is switched back on thereby ending the cycle.

During the above described operations, pressurized air within the air cylinders (sleeve and eject) is exhausted through an exhaust port contained in flip-flops $F–F_1$ and $F–F_2$. This pressurized air is allowed to exhaust when the flip-flop is either set or reset or accordingly when the output ports *c* or *d* are turned off.

In FIG. 12, a time pulse diagram is presented illustrating the pulses for controlling the sleeve retraction mechanism and the ejection mechanism. Additionally, in this Figure, the relative time periods of operation are also illustrated.

It should be noted with respect to the above air logic diagram illustrated in FIG. 11 that these operations could also be controlled by an electrical circuit diagram. The utilization of air logic was selected, however, since the moving parts are controlled by pneumatic control mechanisms and hence the air supply is already present within the system.

A coating applicator 100 for coating internal surfaces in accordance with the present invention is illustrated in FIG. 13. A chamber 101 within the applicator is defined by the area between stationary wall 102, movable wall 103 and pilot 105. During operation, chamber 101 is filled with coating material through line 110 which is connected to a reservoir. Movable wall 103 has an elongated end portion 104, with an end surface 104*a*. End surface 104*a* forms a sealing contact with surface 106 of pilot 105 for sealing the chamber and preventing the leakage of coating material from the chamber. Sealing members 124, which can be flexible rubber seals, are provided for preventing the leakage of fluid between the mating surfaces of walls 102 and 103.

When movable wall 103 is extended, end surface 104*a* contacts surface 106 of pilot 105 thereby closing the end of the chamber. An extremely effective sealing exists between surface 104*a* and surface 106 due to the narrowed area of contact between these two members.

When an internal surface 108 of a member 107 is to be coated, the member is arranged on elongated portion 104 of the chamber. Movable wall 103 is then pushed back towards the rear of the chamber thereby providing an opening 125 within the chamber. Opening 125 allows coating material to flow out from the chamber into contact with surface 108 thereby providing a layer of coating material 109 on the surface. The portion of the surface to be coated can be adjusted by varying the location of pilot 105 and the backward motion of 103. For enabling such an adjustment, pilot 105 is screwed into opening 112 in stationary wall 102 and the location of surface 106 can be adjusted by varying the position of pilot 105 with respect to stationary wall 102. Contact between edge surface 113 of the pilot and internal surface 108 prevents coating material from leaking out of the applicator during the coating operation.

When member 107 is arranged on the elongated portion and movable wall 103 is pushed back, connecting rods 111*a* and 111*b* are likewise pushed in a rear direction. As rod 111*a* travels backwards, knob 117 contacts roller 118 on a lever attached to actuating switch 116. In turn, switch 116 initiates the timing period for controlling the coating operation. At the end of the coating period, rods 111*a* and 111*b* automatically move in a forward direction by an appropriate pneumatic system thereby returning movable wall 103 to its initial position with end surface 104*a* contacting surface 106 and closing the chamber. After the chamber has been closed, an ejection mechanism pushes member 107 off of the pilot into a collecting tray arranged underneath the applicator.

The ejection mechanism includes a plate 119 surrounding elongated portion 104, which plate is pushed in a forward direction along the elongated portion for ejecting coated member 107. Plate 119 is connected to a set of rods 120*a* and 120*b* which are attached to an appropriate pneumatic system. At the end of the coating period, rods 120*a* and 120*b* are pushed in a forward direction thereby causing plate 119 to eject member 107. As the rods travel in a forward direction, knob 123 located on rod 120*a* contacts roller 122 mounted on a lever of a limit switch 121. This limit switch deactivates the pneumatic system causing the forward movement of the ejection rods and in turn causes the pneumatic system to return the rods and hence plate 119 to their initial positions.

As member 107 is ejected, edge 113 of pilot 105 skims the excess coating material off of the internal surface and smooths out coating layer 109.

Spring 114 located within chamber 115 serves to bias movable wall 103 into its closed position. Spring 114 also acts as a fail-safe mechanism for closing the opening within the chamber, in case there is a failure in the pneumatic drive system attached to rods 111*a* and 111*b*.

The same type of pneumatic drive mechanisms and control circuitry as described above with respect to the applicator for coating external surfaces would be utilized in controlling the operation of coating applicator 100. During operation it is merely necessary for the operator to place member 107 onto the elongated portion and to press the member back, the remainder of the operation is entirely automatic.

It is noted that the above description and the accompanying drawings are merely provided to present an exemplary embodiment of the present invention and additional modifications of this embodiment are possible within the scope of this invention without deviating from the spirit thereof.

I claim:

1. A coating apparatus for coating an internal surface of a bore within a member, the coating apparatus comprising:

a chamber having an elongated portion with an external wall capable of being inserted inside of the bore of the member to be coated;

means for filling said chamber with coating material;

means for sensing the arrangement of the member to be coated on said elongated portion of said chamber;

means for providing an opening along said external wall of said elongated portion of said chamber for allowing coating material to pass through said opening into contact with the internal surface of the member to be coated, said opening extending along a continuous path around the entire circumference of said elongated portion of said chamber; and, means responsive to said sensing arrangement for ejecting a coated member from said elongated portion of said chamber and closing said opening.

2. A coating apparatus as defined in claim 1 wherein a section of the lateral end wall of said chamber attached to said elongated portion and a section of the wall of said elongated portion are movable in a direction for providing said opening and said movable sections of said chamber are movable by pressure exerted along the longitudinal axis by the member to be coated when arranged on said elongated portion.

3. A coating apparatus as defined in claim 2 further comprising means for returning said movable sections of said chamber to their initial positions after coating of the member.

4. A coating apparatus as defined in claim 3 wherein said means for returning said movable sections of said chamber includes means for biasing said sections into positions for closing said opening.

5. A coating apparatus as defined in claim 1 further comprising timing means for determining the coating period, said timing means being actuated by said means for providing said opening and said timing means at the end of the coating period actuating said ejecting means.

6. A coating apparatus as defined in claim 5 wherein said ejecting means engages the coated member along its lateral end surface facing said chamber.

7. A coating apparatus as defined in claim 6 wherein said ejecting means includes a flat plate located between the lateral end wall of said chamber and said member to be coated and means for moving said plate in a direction away from said chamber for ejecting the coated member.

* * * * *

UNITED STATES PATENT OFFICE

CERTIFICATE OF CORRECTION

Patent No. 4,079,693 Dated March 21, 1978

Inventor(s) ROBERT J. COTTER

It is certified that error appears in the above-identified patent and that said Letters Patent are hereby corrected as shown below:

At Column 7, Line 53, Delete FIG. 18 and Add Fig. 8.

Signed and Sealed this

*Third* Day of *August 1982*

[SEAL]

*Attest:*

GERALD J. MOSSINGHOFF

*Attesting Officer*

*Commissioner of Patents and Trademarks*